United States Patent [19]

Hollingsworth

[11] 4,373,647

[45] Feb. 15, 1983

[54] VALVE FOR USE WITH FLEXIBLE DISPENSING TUBE

[76] Inventor: Calvin R. Hollingsworth, 4744 NE. 180th, Seattle, Wash. 98155

[21] Appl. No.: 341,815

[22] Filed: Jan. 22, 1982

Related U.S. Application Data

[62] Division of Ser. No. 157,406, Jun. 9, 1980, abandoned.

[51] Int. Cl.[3] ..... B67D 3/00

[52] U.S. Cl. ..... 222/528; 222/105

[58] Field of Search ..... 222/527, 528, 529, 105, 222/146 C, 214, 531, 532, 102, 503, 505, 526; 251/4, 6, 9

[56] References Cited

U.S. PATENT DOCUMENTS 2,721,052 10/1955 Hull ..... 251/6

*Primary Examiner*—Stanley H. Tollberg

*Attorney, Agent, or Firm*—Cole, Jensen & Puntigam

[57] ABSTRACT

A dispenser for use with bulk containers of milk or other refrigerated liquid products having a gravity feed, dispensing nozzle extending from the bottom of a bladder or other liquid container. The valve, through the use of an articulated linkage, serves to both open and close the flexible nozzle and further to retract the nozzle and the liquid contained therein up into the refrigerated main storage area. A basket pivotally mounted upon a track system receives the bladder and is capable of both pivoting about a horizontal axis and moving outwardly with respect to the box to permit easy removal and replacement of the liquid containing bladder.

6 Claims, 17 Drawing Figures

9b

10b

11b

VALVE FOR USE WITH FLEXIBLE DISPENSING TUBE

This is a division of application Ser. No. 157,406, filed June 9, 1980, now abandoned.

BACKGROUND OF THE INVENTION

As has been common for many years, establishments such as restaurants, hospitals, dormitories or the like which serve large numbers of people and therefore dispense large quantities of a product like milk, have determined that it is economical for themselves and more pleasing to the customers to serve the milk in a glass, rather than a plastic package, the liquid itself being dispensed from a bulk container. The bulk container is normally housed within a refrigerated closed box-like container and the dispensing nozzle extends from the bottom of the box to a position proximate the top of a liquid receiving container placed in a receiving position.

Bulk liquid dispensers of the type described have been known for years and have included as an integral part thereof a dispensing nozzle which have included an operating handle convenient to the dispensing party and a means to crimp or pinch the normal rubber or plastic tube communicating with the interior of the bulk container. The problems with the currently available dispensing mechanisms include the fact that the single pinch or crimp does not effectively close the tube and therefore, there is some continuous leakage when the apparatus is not dispensing and further, the tube and the contents remaining therein are not refrigerated, are subject to contamination by ambient air, the hands of other operators, whether intentional or not, and further, by any insects which may be in the vicinity.

The present liquid bulk dispensers of the type hereinabove described also tend to be awkward to load with a new full container or in the alternative, very awkward to remove a container which leaks and must be disposed of before it is empty. The awkwardness of loading or unloading the available dispenser is generated by several factors including the lack of rigidity of the liquid containing bladder bag itself, the weight of the bladder bag and contained liquid, and further the necessity of accurate placement of the bladder which is awkward such that the nozzle is aligned properly with the valve structure and then feeding it downwardly to extend out of the cabinet.

References known to the present applicant include the following: U.S. Pat. No. 2,377,261 granted to Norris, U.S. Pat. No. 2,683,556 granted to Norris et al, U.S. Pat. No. 2,718,985 granted to Tamminga, U.S. Pat. No. 2,752,068 granted to Bryant, U.S. Pat. No. 3,395,838 granted to Beres et al, U.S. Pat. No. 3,637,118 granted to Petrocy et al, U.S. Pat. No. 926,339 granted to Openchowski, and U.S. Pat. No. 3,934,758 granted to Kipp.

None of the patents disclosed hereinabove teach the specific nozzle mechanism disclosed which opens and seals a dispensing tube and further retracts the tube into the container in the closed position. Further, none of the patents disclose the novel bladder containing and supporting structure permitting movement into and out of the refrigerated box.

With the above noted prior art in mind, it is an object of the present invention to provide a dispensing mechanism for use on bulk milk containers or the like wherein the dispensing nozzle and the captured tube and contained fluid is retracted into the refrigerated compartment when the valve is in the closed position.

It is another object of the present invention to provide a nozzle mechanism for a bulk dispensing unit wherein the flexible dispensing tube is crimped in more than one place in the closed position thus assuring a drip free operation.

It is still another object of the present invention to provide a nozzle mechanism for use with bulk containers wherein the dispensing nozzle, when not in use, is retracted to the interior of a closed container preventing contamination.

Still a further object of the present invention is to provide a dispensing mechanism for a bulk liquid product wherein the product is contained within a bladder which in turn is supported and stored in a rigid supplementary container which is mounted for controlled movement relative to an exterior shell and thus easily loaded and placed into position within the shell.

Yet a still further object of the present invention is to provide a bulk liquid dispensing unit wherein the dispensing nozzle is easily removable from an exterior protective shell and can be attached to the replaceable bulk container prior to final placement within the shell.

Yet another object of the present invention is to provide a track-like structure within a container enclosing shell so that a loaded unit may be easily placed within the shell or removed therefrom by means of wheels mounted to a rigid interior supporting structure interacting with the track structure.

Yet a still further object of the present invention is to provide a series of cams or levers which are integrally related with a track mechanism within an enclosing shell or the like to control and guide placement and movement of a loaded container mounted within said shell and supported by said tracks.

FIG. **9*a*** is a simplified sectional view of the dispensing container in the operative position.

Figure 9A:
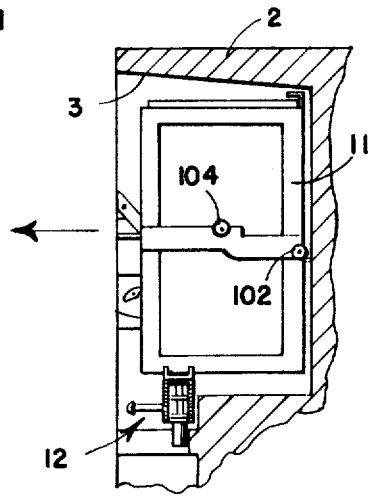

FIG. **9*b* is an enlarged view of the cam and track mechanism showing the relative location of the wheels and cams when the dispenser is as is shown in FIG. 9*a***.

Figure 10A:
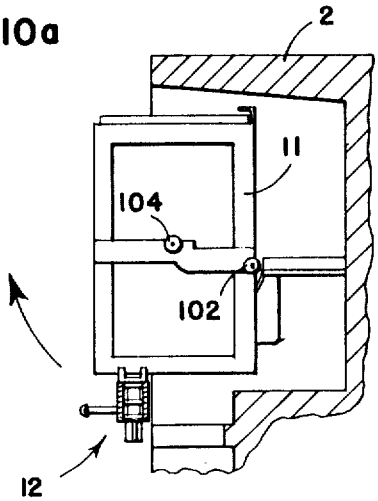

FIG. 10*a* is a simplified sectional view showing the dispensing mechanism in a partially removed condition.

FIG. 10*b* is an enlarged sectional view showing the relative position of the wheels, cams and the like when the dispenser is in the position shown in FIG. 10*a*.

Figure 11A:
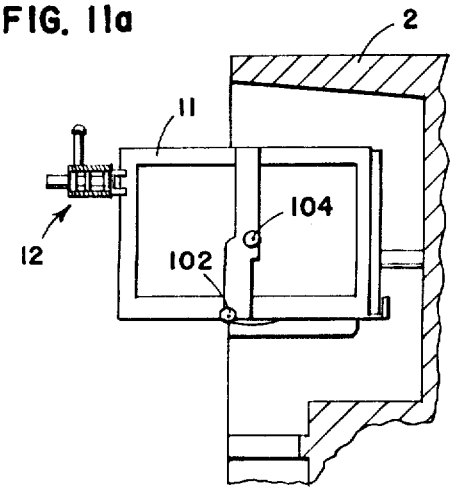

FIG. 11*a* is a simplified sectional view showing the dispensing mechanism in position for loading and unloading.

FIG. 11*b* is an enlarged elevational view of the track and interrelationship with the wheels for the container when in the position shown in FIG. 11*a*.

Figure 12:
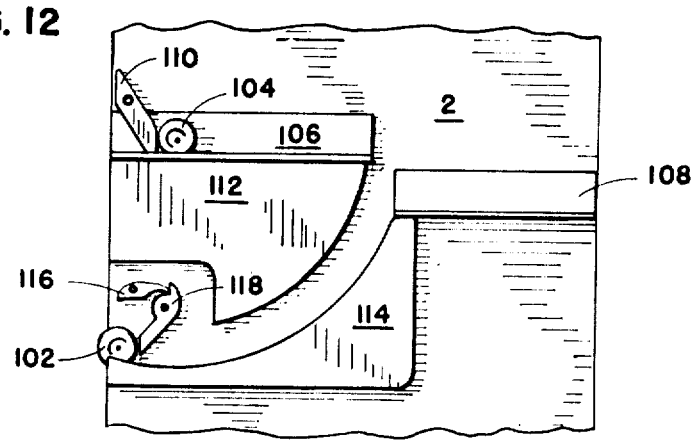

FIG. 12 is the relationship of the cam mechanism and the wheels when the fluid container is being loaded and unloaded.

Figure 13:
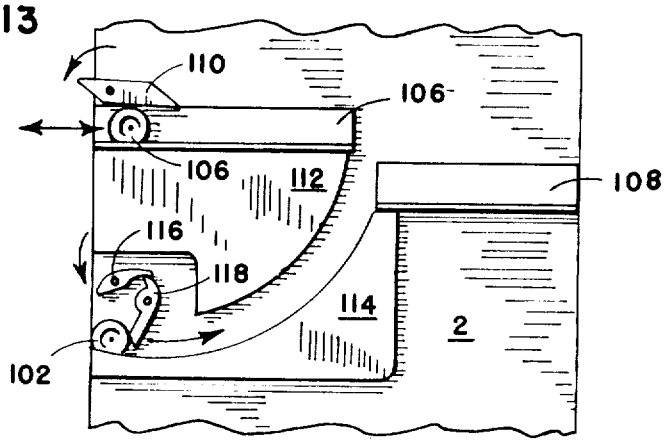

FIG. 13 discloses the relative position of the cams and wheels when the entire basket structure is to be removed and/or returned.

Figure 14:
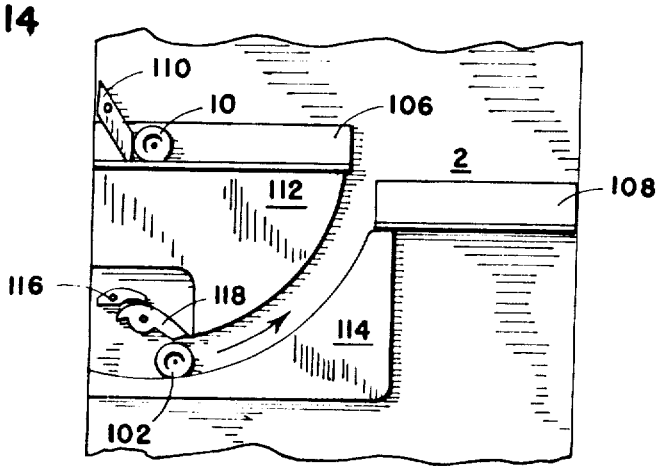

FIG. 14 discloses the relationship between the cams and the wheels when the basket is being returned to its operational condition.

DETAILED DESCRIPTION OF THE DRAWINGS

Figure 1:
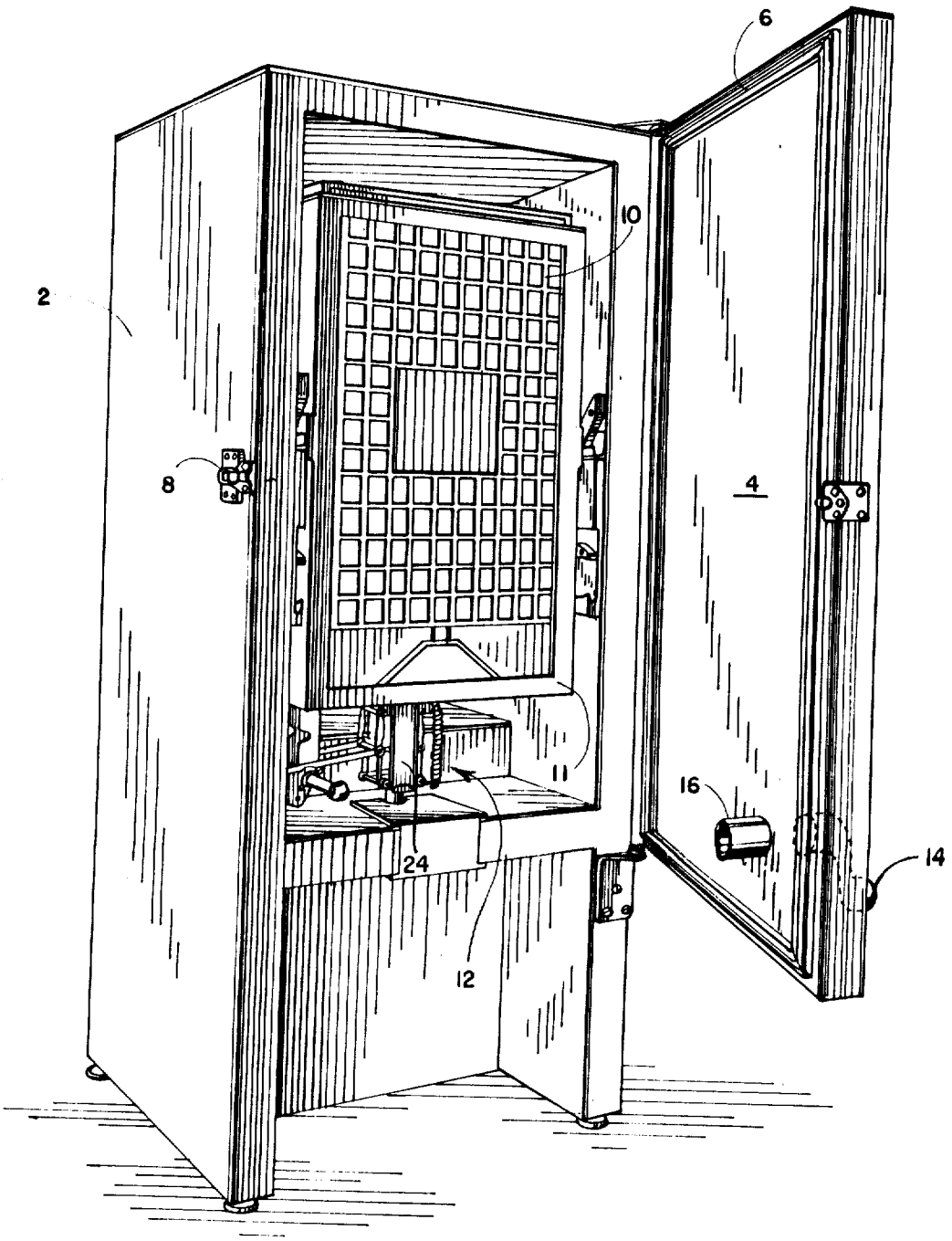
FIG. 1 is an isometric view of a refrigerated container including the inventive valve structure and liquid bladder support structure.

As depicted in FIG. 1, the present invention deals primarily with a refrigerated dispensing device and in particular, one for dispensing milk. It is to be understood, however, that the invention is not limited to refrigerated containers. As seen in FIG. 1, the invention is incorporated in an insulated cabinet 2, having a front opening door 4, including the standard strip insulation 6, which assures the relative constant interior temperature by limiting heat leaks. As to be noted in this view, the cabinet 2 includes an opening in the lower front portion to receive a liquid receiving container such as a glass or pitcher for the material being dispensed. It is to be understood that this particular opening will be of any convenient size and probably would be standardized. As will be obvious, the cabinet also includes a means for securing the door in a closed position designated in this case by, but not necessarily to, a standard latch 8. Located within the box and completely enclosed when in use is a flexible container or bladder supporting basket 10 supported by framework 11 having secured to the bottom thereof, as explained hereinafter, a dispensing nozzle 12 and, extending through the door 4 itself, a dispensing handle 14. As is obvious, the refrigerated box would also contain the necessary compressor and conduits to perform the cooling function but since these are not a part of the present invention, they are not shown.

Figure 2:
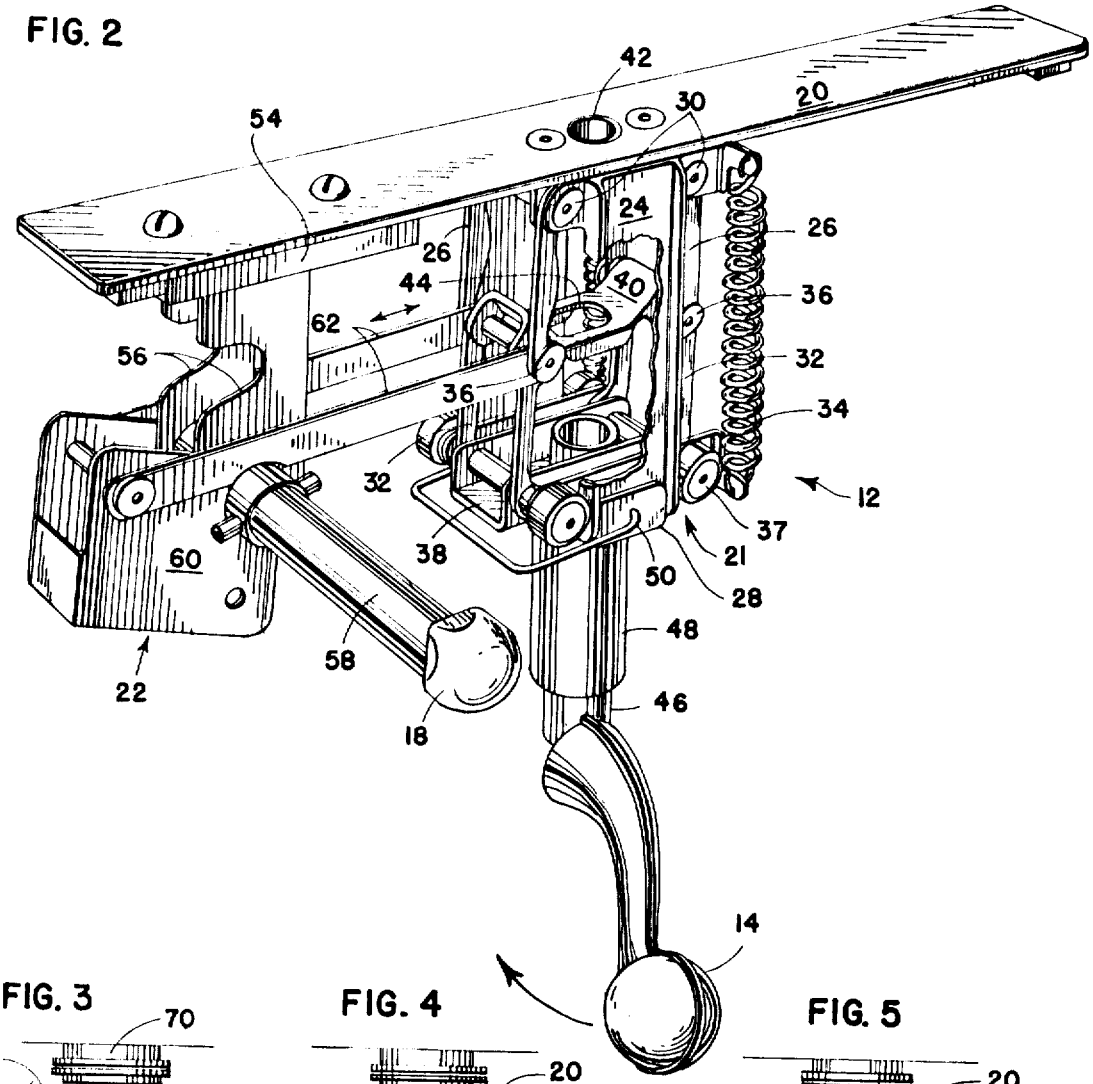
FIG. 2 is a perspective view of the inventive valve mechanism removed from the bladder supporting basket.

Referring now to FIG. 2, the dispensing mechanism designated generally as 12, is shown in greater detail. As seen in this view, but not an actual portion of the dispensing mechanism is the handle 14 which as noted above, is mounted to the exterior of the door and interconnected with a female socket member 16 (see FIG. 1) which mates with male member 18 for rotational movement therewith. As the door is opened, the socket member 16 separates from member 18. The nozzle structure includes a mounting plate 20 which will be secured to the bottom of the basket and its framework as described in greater detail hereinafter and having mounted thereto the tube containing and closing mechanism generally designated as 21 and the actuating mechanism 22.

Referring to the tube containing and closing mechanism 21 in detail, it can be seen that it includes a substantially rectangular shaped support bracket or framework 24 extending downwardly from each side of mounting plate 20. Mounted to framework 24 are 2 pairs of parallel coacting toggle mechanisms having an upper first set of legs 26 pivotally secured to the frame member 24 at its upper portion by means of pivots 30. A second set of parallel leg members 32 are pivotally linked at 36 to the upper leg members 26 and pivotally linked to a horizontal linking plate 38 at the lower portion. Parallel leg members 26 are held in a constant, relative position at the upper end by means of the frame member 24 and held at a constant relative position at the medial portion by means of a horizontal linking member 40 and at the lower end by horizontal linking member 38. Spanning the two portions of framework 24 at the lower end is a horizontally disposed U-shaped element 28 pinned to 24 by clip 50 and including as an integral portion thereof, downwardly extending sleeve member 48.

It is to be noted that the attaching bracket 20 includes as an integral portion thereof a vertical opening 42 to receive the dispensing tube extending from the liquid containing bladder. Horizontal member 40 likewise includes an opening 44 for a like purpose and bottom horizontal member 38 has attached thereto a downwardly extending vertical tube member 46 telescopically received in the tube member 48 also for receiving the dispensing tube. Spring 34 which is secured to framework 24 at its upper end and to plate 38 at its lower end assists in the movement of the valve to its closed position and further retains it in that position.

The actuating mechanism includes a mounting member 54 secured to the lower portion of plate element 20 to which is secured a downwardly extending pair of configured mounting plates 56. Rod 58, upon the outer end of which male member 18 is located, extends through a pair of aligned holes in the plates 56 and has rigidly secured thereto a rectangularly configured crank arm 60 to which are secured a pair of parallel linking members 62. Linking members 62 are secured at their other end to the interconnecting pivot point 36 and the parallel leg members 26 and 32 of the nozzle mechanism 21.

Figure 3:
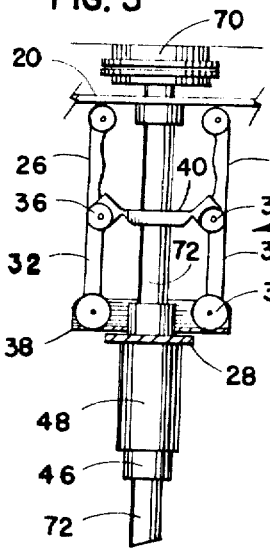
FIG. 3 is a simplified view of the valve structure in the dispensing position with the tubing extended.
Figure 4:
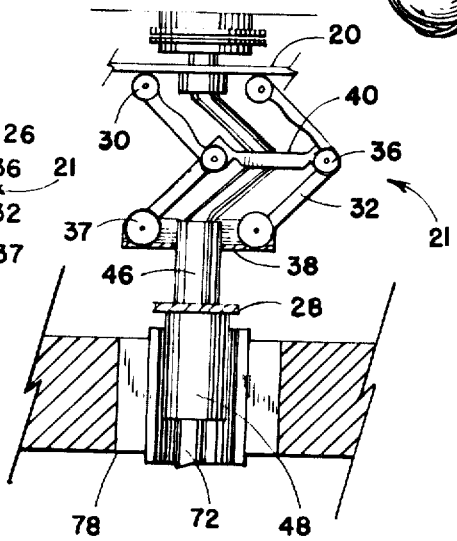
FIG. 4 is a simplified view of the valve structure in a partially retracted position.
Figure 5:
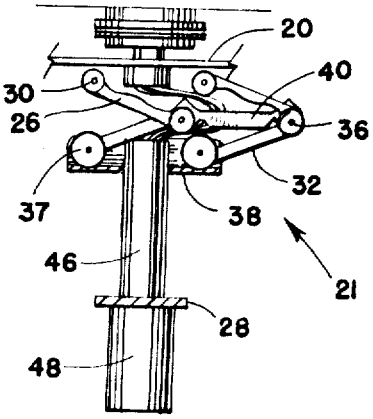
FIG. 5 is a simplified view of the valve structure in a fully retracted or closed position.

Referring now to FIGS. 3, 4 and 5, it can be seen that the fluid container (not shown) terminates in a downwardly projecting stopper like element 70 utilized for both filling and dispensing, having extending downwardly therefrom for dispensing, a thin flexible tube member 72 which passes through the bore 42 in plate 20, through the opening 44 in plate 40 and passes through the tube 46. Tube 46 is telescoped within tube 48 which passes through the bottom of cabinet 2. In operation, the linking members 62 (see FIG. 2) are moved to the right, causing the nozzle structure 21 to collapse in a scissor-like action. The collapse of the nozzle structure pinches the tube 72 in three distinct bends and further draws both the tube and the telescoping cylinder member 46 up into the interior of the refrigerated container to retard souring of the liquid contained within the tube and substantially reduce contamination.

Figure 6:
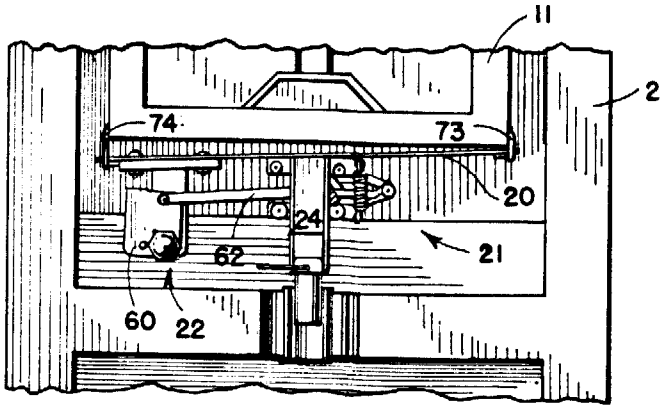
FIG. 6 is a partial sectional view of the valve within the refrigerated container in the retracted or closed position.

Referring now to FIG. 6, the bottom portion of the cabinet 2 can be seen as well as the lower portion of the basket-like container 10 to which the rectangular, nozzle supporting plate 20 is secured. As seen in this view, a pair of brackets 72 and 74 are secured to the lower portion of frame element 6. The plate element 20, when in operating condition is secured by brackets 72, 74. To secure plate 20 in position, one end is slipped through bracket 72 until the opposite end of plate 20 clears bracket 72 and then moved in the opposite direction until secured by both brackets 72 and 74. A combination of the stops located on plate 2 and the force of gravity retains the nozzle mechanism in position. Once the door is closed and secured, interlocking the male and female handle members and the dispensing tube is located within the dispensing aperature, the chance of the mechanism shifting is virtually nil. Referring in particular to FIG. 6, the lower portion of the plastic or rubber tube 72 as well as the lower portion of nozzle 46, would extend through cylinder 48 and through an opening generally designated 76 would extend through the insulated bottom portion 78 of cabinet 2.

Figure 7:
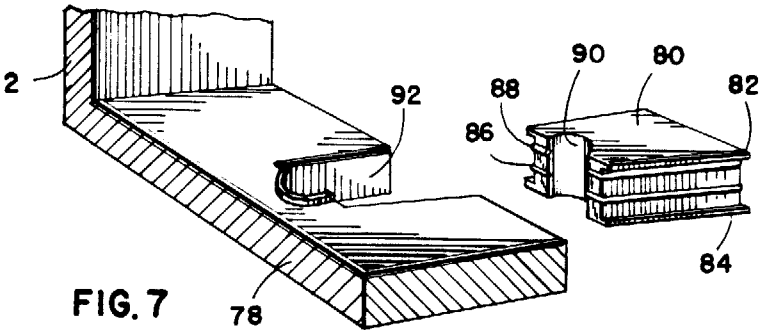
FIG. 7 is a partial view of the bottom of the refrigerated container showing the location of the valve receiving opening.

Referring now to FIG. 7, it can be seen that the insulated cabinet 2 includes as an integral portion thereof an insulated bottom 78. In order to place and remove the dispensing nozzle mechanism, a removable somewhat wedge-shape portion 80 including outwardly extending flanges 82 and 84 as well as insulating ridges or seals 86, 88 and an opening 90 is provided which slips into a complimentary opening 92 within the bottom 78. Once in position, the outwardly extending flanges 82 and 84 lock the element preventing upward and downward movement and the closed door prevents any outward lateral movement thus assuring the entire box is insulated at all times. As seen hereinabove, the lower portion of the nozzle mechanism extends downwardly through the opening during the dispensing process.

Figure 8:
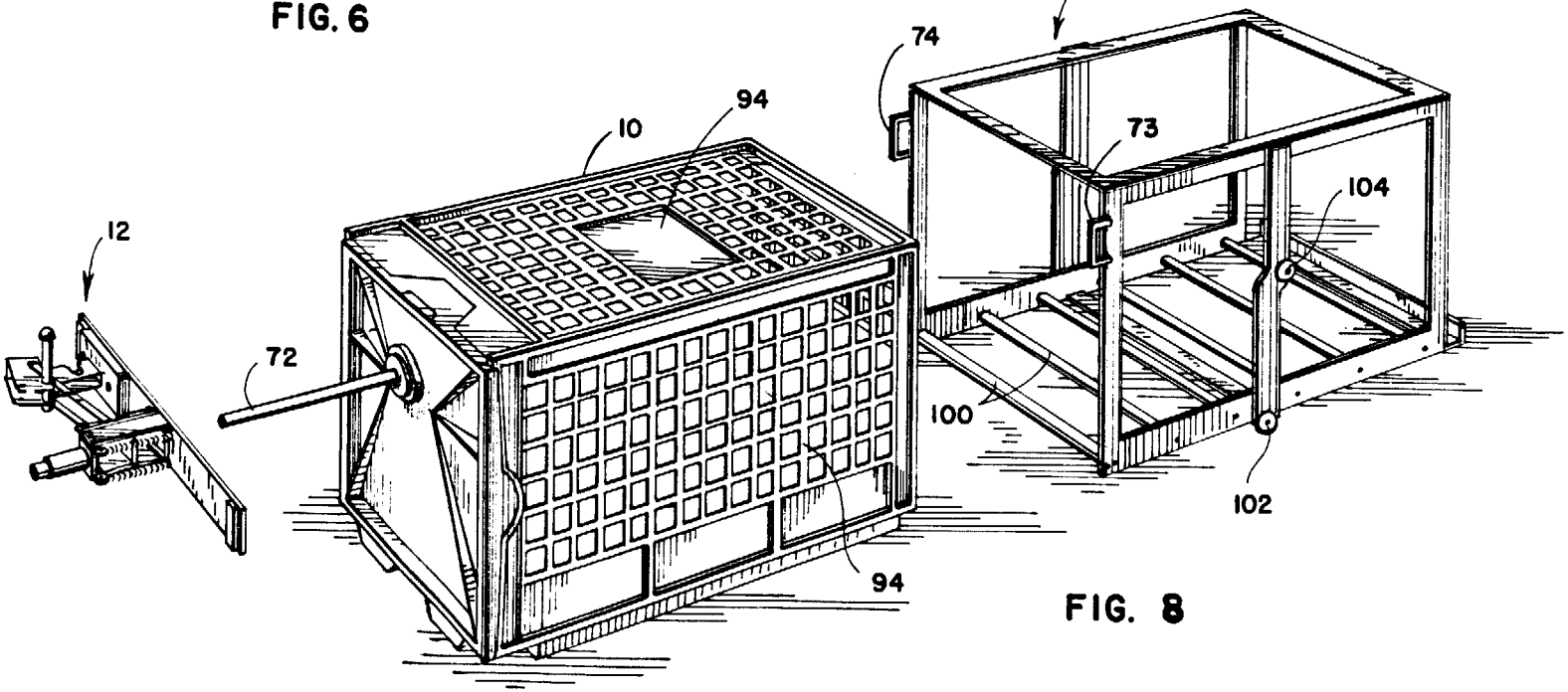
FIG. 8 is an exploded view showing the bulk fluid container receiving basket, the removable valve mechanism, and the basket supporting and containing framework which interacts with the track mechanism within the refrigerated container.
Figure 9A:
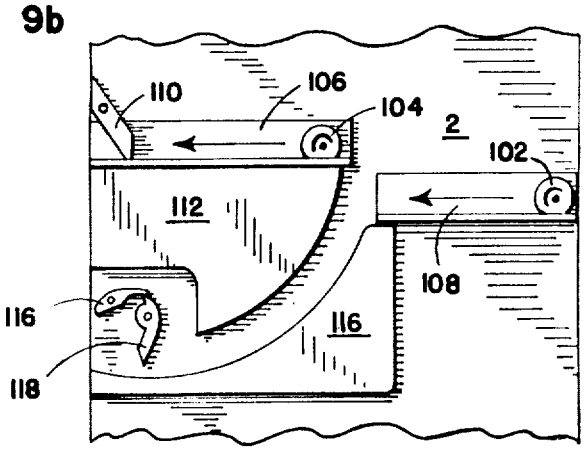
Figure 10A:
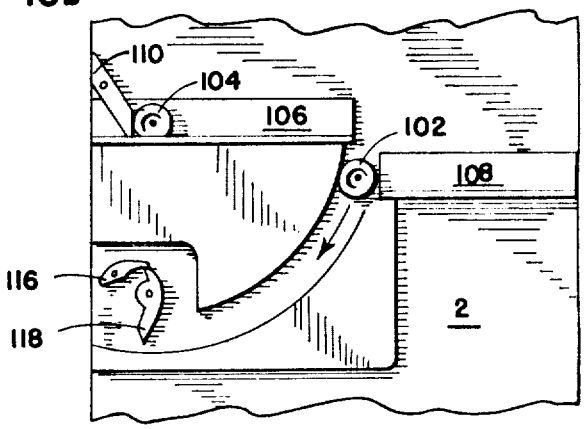
Figure 11A:
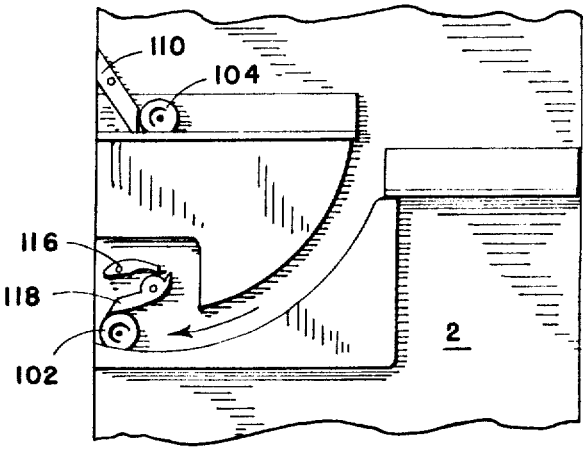

Looking now to FIG. 8, the major portion of the liquid containing bladder supporting and containing structure as well as the dispensing mechanism is shown in exploded detail. As seen in this view, the entire dispensing mechanism 12 is removable and is adapted to telescopically receive the outwardly projecting rubber or plastic tube 72 which is an integral part of the bladder. As can be seen, the bladder has been placed inside a basket-like member 10 which is in turn slipped within frame 11. Basket-like member 10 is of a rigid construction and includes side supporting walls 94 such that the liquid containing bladder itself may be supported at all times and need not have any integral strength. The framework 11 into which the basket is placed includes as an integral portion thereof the dispensing mechanism 12, receiving ears 73, 74 and a plurality of rollers 100 along the back portion which becomes the bottom during load and unload for ease in placing and removing the basket 10. The frame 11 includes sufficient frame and lateral support means to assure rigidity and includes a pair of rollers 102, 104 mounted on each side of the framework for interaction with an integral track mechanism formed in the sides of the insulated container itself as explained hereinafter:

Referring now to the sequence of FIGS. 9–11, there is shown in the "a" series a somewhat schematic view of the insulated container 2, the framework 11 including rollers 102, 104 and the dispensing mechanism 12.

As seen in these views, the interior upper surface or ceiling 3 of the cabinet 2 slopes to the rear such that any condensate will drain to the back of the cabinet and thus down the back without contaminating the liquid container or the structure immediately surrounding including the nozzle mechanism. As in FIG. 9*a*, the liquid container is in its operational condition i.e. that condition when the door would be closed, the plug 80 secured in position and the liquid capable of being dispensed.

In FIG. 10*a*, the container, the frame and the basket have been moved to a position outside of the cabinet itself and into a position in preparation for tipping of the entire interior structure to a position such as is shown in FIG. 11*a* whereat the rollers will be on the bottom of the frame preparatory to removing the dispensing structure 12 and the replacement of the liquid bladder.

As seen in FIG. 9*b*, the interior of the cabinet 2 includes a pair of substantially parallel but not colinear angle members 106, 108 which are secured to each of the side walls and upon which established platform wheels 102, 104 are free to move. At the forward end of track 106 there is located a lever member 110 which, as will be described in greater detail with respect to FIGS. 10*b* and 11*b* and 13, prevents the wheels 104 from moving further outward of the cabinet until it is so desired. The forward end of angle member 108 is adjacent the curved slot formed by plate members 112, 114 which guides wheels 102 in tipping the container 11. Also seen in this view are a pair of latch members 116, 118 which as seen in FIG. 11*b* permit the wheel 102 to freely pass outwardly and then as shown in FIG. 12, serve to stabilize the frame during loading and unloading.

Reference is now had to FIG. 12 wherein the various container controlling and guiding elements are shown in their various interrelated positions for removing and replacing the container at its related framework 11. As seen in FIG. 10, the wheels 102, 104 and the latches 110, 116, 118 are in a position locking the container in a horizontal configuration as shown in FIG. 11*a*. It is to be noted that latch 118 is prevented from pivoting by latch 116 therefore preventing the container from returning to the vertical or normal position. The container is also prevented from moving outwardly by the interaction of latch 110 with wheel 104. As seen in FIG. 13, latch 110 has been pivoted allowing wheel 104 to move and therefore the entire container may be removed for cleaning, repair or replacement, if desired. Upon returning the container, latch 110 is again moved to its horizontal position as shown and latch 116 is moved upwardly such that latch 118 may pivot and wheel 102 pass thereby going back into the channel between plates 112, 114. Continual movement of the wheel 102 in the direction of the arrow will allow the latch 118 to return to the position as shown in FIGS. 9 and 10*b* and then the wheel will move to angle member or track 108 reversing the process and returning the container to its dispensing position.

Thus, it can be seen that the present invention provides a novel and unique dispensing mechanism which provides a positive closure for the device and further retracts the nozzle and the product retained within the nozzle, when not in use, upwardly into the refrigerated space keeping it cool and further removing it from contamination. The unique liquid containing elements and their supporting framework and guidance elements provide a simple yet easy solution to both the problem with cleanliness of the apparatus and further the removal of the awkwardness handling a flexible bladder often used as containers for bulk liquids.

What is claimed is:

1. A valve mechanism for use with a flexible dispensing tube or the like comprising:

upper plate means adapted to be secured in a stationary position relative to the dispensing tube when in use, said plate including an opening to receive the dispensing tube, a first set of substantially parallel pivotally mounted linking elements having one end secured to one face of the upper plate means, middle plate means pivotally secured to the other end of the first set of elements, said middle plate means including an aperture to receive the tube means, a second set of substantially parallel linking elements pivotally mounted linking elements secured to the middle plate means on the face opposite the connection with the first set of linking elements, bottom plate means pivotally secured to the other end of the second set of linking elements, said bottom plate means including an aperture to receive the dispensing tube, and actuating means to move the two sets of linking elements out of alignment crimping the dispensing tube and preventing fluid flow therethrough.

2. A valve mechanism as in claim 1, wherein the actuating mechanism comprises a cam, operated by an outwardly projecting handle, connected by an elongated link to the middle plate means pushing it out of alignment to effect closure.

3. A valve mechanism as in claim 1, and further including spring means to assist in the crimping and to retain the valve in a closed position.

4. A valve mechanism as in claim 1 and further including a rigid tube secured to the bottom plate to shield the dispensing tube.

5. A dispensing mechanism for use with a flexible tube comprising a set of substantially parallel articulated arms pivotally secured to a first plate member having a tube-receiving aperture passing therethrough, a tube displacing means at the point of articulation and, a second plate means secured to opposite end of the articulated arm having a tube receiving aperture therethrough, and means to articulate the arms whereby a tube passing through the apertures is bent at three separate locations, pinching the tube and preventing fluid from flowing therethrough.

6. A dispensing mechanism as in claim 5, wherein the articulation of the arms foreshortens the distance between the first and second plate means.

* * * * *